US007948339B2

(12) United States Patent
Burger et al.

(10) Patent No.: US 7,948,339 B2
(45) Date of Patent: May 24, 2011

(54) ELECTROMAGNETIC DRIVE UNIT AND AN ELECTROMECHANICAL SWITCHING DEVICE

(75) Inventors: Josef Burger, Schmidgaden (DE); Reinhard Maier, Herzogenaurach (DE); Bernd Trautmann, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 207 days.

(21) Appl. No.: 12/310,356

(22) PCT Filed: Mar. 2, 2007

(86) PCT No.: PCT/EP2007/001832

§ 371 (c)(1),
(2), (4) Date: Feb. 23, 2009

(87) PCT Pub. No.: WO2008/022660

PCT Pub. Date: Feb. 28, 2008

(65) Prior Publication Data

US 2009/0251237 A1 Oct. 8, 2009

(30) Foreign Application Priority Data

Aug. 25, 2006 (EP) ..... 06017745

(51) Int. Cl.
*H01H 67/02* (2006.01)

(52) U.S. Cl. ..... 335/131; 335/132; 335/270

(58) Field of Classification Search ..... 335/131–132, 335/270, 273, 279
See application file for complete search history.

(56) References Cited

U.S. PATENT DOCUMENTS

| | | | | |
|---|---|---|---|---|
| 2,391,277 | A * | 12/1945 | Stapleton | 335/253 |
| 4,855,702 | A * | 8/1989 | Swanson et al. | 335/261 |
| 6,533,240 | B1 | 3/2003 | Lotz | |
| 7,061,352 | B2 * | 6/2006 | Lin | 335/108 |
| 7,696,846 | B2 * | 4/2010 | Maier et al. | 335/201 |
| 2003/0189474 | A1 | 10/2003 | Lang | |

FOREIGN PATENT DOCUMENTS

| | | |
|---|---|---|
| DE | 103 31 339 | 2/2005 |
| EP | 1 101 233 | 5/2001 |
| EP | 1353348 | 10/2003 |
| JP | 2000011837 A | 1/2000 |

* cited by examiner

*Primary Examiner* — Ramon M Barrera
(74) *Attorney, Agent, or Firm* — Harness, Dickey & Pierce, P.L.C.

(57) ABSTRACT

An electromechanical switching device, especially a contactor or a multifunctional device including a contactor, includes at least one stationary contact piece, at least one movable contact piece movable to and from the at least one stationary contact piece for opening or closing a current path and an electromagnetic drive unit including a yoke and a coil and a movable armature. In at least one embodiment, the electromagnetic drive unit is adapted to displace the movable contact piece in response to a voltage applied to the coil. The at least one movable contact piece and the at least one stationary contact piece are adapted to limit movement of the armature after activation of the electromagnetic drive unit.

20 Claims, 3 Drawing Sheets

Background Art

ELECTROMAGNETIC DRIVE UNIT AND AN ELECTROMECHANICAL SWITCHING DEVICE

PRIORITY STATEMENT

This application is the national phase under 35 U.S.C. §371 of PCT International Application No. PCT/EP2007/001832 which has an International filing date of Mar. 2, 2007, which designated the United States of America and which claims priority on European application No. 06017745.8 filed Aug. 25, 2006, the entire contents of each of which are hereby incorporated herein by reference.

FIELD

At least one embodiment of the invention generally relates to the art of electromagnetic drive unit design, and further generally relates to electromechanical switching devices.

BACKGROUND

FIG. 1 illustrates a section of a conventional electromagnetic drive unit 1, comprising a yoke 10 with a coil 11 placed around the middle leg 12, and an armature 15. When a current, preferably controlled by a control unit 99, is led through the coil 11, the yoke 10 is magnetized and thus pulls the armature 15 towards itself until the outer pole legs 16, 17 of the armature 15 clack onto the outer pole legs 13, 14 of the yoke 10.

It is generally required that electromagnetic drive units of this kind need to last millions of operation cycles where the electromagnetic drive unit is activated and then deactivated, especially when used in electromechanical switching devices, in particular in contactors. Referring back to FIG. 1, which shows also a simplified electromechanical switching device 50, where electromagnetic drive units are used to drive movable contact pieces 21, preferably placed on a movable contact bridge 20, to and from stationary contact pieces 6 in order to close or open a current path, such as between terminals 5*a* and 5*b*. The armature 15 preferably moves the contact bridge 20 via a bar 7.

In order to avoid arcing between the movable contact pieces and the stationary contact pieces, the contacts of the electromagnetic switching device need to be moved relatively fast. The pulling force of the armature 15 has to overcome the high forces of the resilient damping members 27, such as contact springs. Consequently, the resulting clacking of the armature 15 to the yoke 10 causes material fatigue especially around the points of contact, denoted in FIG. 1 with reference numeral 18. To compensate the clacking, a damping system, preferably with a resilient damping member 27, is commonly used.

To make the armature lighter, such as in the manner proposed in DE 10 331 339 A1, provides some advantage because the impact caused by the clacking can so be reduced. In this kind of implementation, especially if combined with a solution proposed in EP 1 101 233, the armature can at least partly be made of powder magnetic material, and further be hardened by using suitable polymers, like epoxy resin. A further advantage of this kind of solution is a better versatility for the shape of the armature and yoke, in contrast to prior solutions in which the armature and yoke were made of stapled metal sheets allowing simple shapes only.

A drawback of a solution of the above kind is that the proposed material for the yoke and the armature is brittle and therefore not resistant enough against impacts, therefore severely limiting the expected life time of the electromagnetic drive unit and thus not being very suitable for use in an electromechanical switching device.

SUMMARY

At least one embodiment of the invention is directed to an electromechanical switching device with an increased expected life time.

At least one embodiment of the invention is directed to an electromechanical switching device, especially a contactor or a multifunctional device comprising in addition to a contactor also further units, such as a circuit breaker, comprising at least one stationary contact piece, at least one movable contact piece movable to and from said at least one stationary contact piece for closing or opening a current path, and an electromagnetic drive unit. The electromagnetic drive unit may be adapted to displace said movable contact piece in response to a voltage applied to the coil.

If the at least one movable contact piece and the at least one stationary contact piece are adapted to limit movement of the armature after activation of the electromagnetic drive unit, the impact between the yoke and the armature can be alleviated. In addition to this, the electromechanical switching device may comprise at least one stop adapted to limit movement of the armature after activation of the electromagnetic drive unit.

If in an electromagnetic drive unit comprising a yoke, a coil and a movable armature, the yoke and the armature have a matched shape so that, when the coil is activated, the armature is adapted to at least partially cross the yoke, the stress due to the impact can be avoided or at least alleviated.

If the yoke comprises a leg or an edge for accommodating a coil, and if the armature shows at least one opening adapted to let said leg or edge to at least partially to penetrate into the armature, the impact between the leg and the armature can be alleviated or avoided, while still enabling the use of a coil of adequate size to cause a strong enough magnet field with the yoke to reliably drive the armature. Furthermore, the armature may move further towards the yoke.

If the yoke comprises one or two outer pole legs or an edge that enables or enable the armature to move past the responsive pole leg, the impact may be alleviated or completely avoided.

If the armature comprises an edge that extends from a top part of the armature towards the yoke, and comprises at least one region adapted to reach the level of a base of the yoke upon activation of the electromagnetic drive unit, a relatively large movement of the armature may be obtained while still alleviating or completely avoiding the adverse effect of the impact.

Particularly advantageously at least one embodiment of the invention can be carried out, if the armature or the yoke comprises magnetic powder material, preferably sustained with a synthetic material, such as a polymer and in particular epoxy resin.

If in an electromagnetic drive unit comprising a yoke, a coil and a movable armature, the yoke and the armature have a matched shape so that, when the coil is activated, the armature is adapted to at least partially cross the yoke, the stress due to the impact can be avoided or at least alleviated.

BRIEF DESCRIPTION OF THE DRAWINGS

In the following, the example embodiments of the invention are discussed in more detail with reference to the examples shown in the accompanying drawings, of which.

Same reference numerals refer to similar structural elements throughout the description.

DETAILED DESCRIPTION OF THE EXAMPLE EMBODIMENTS

Figure 1:
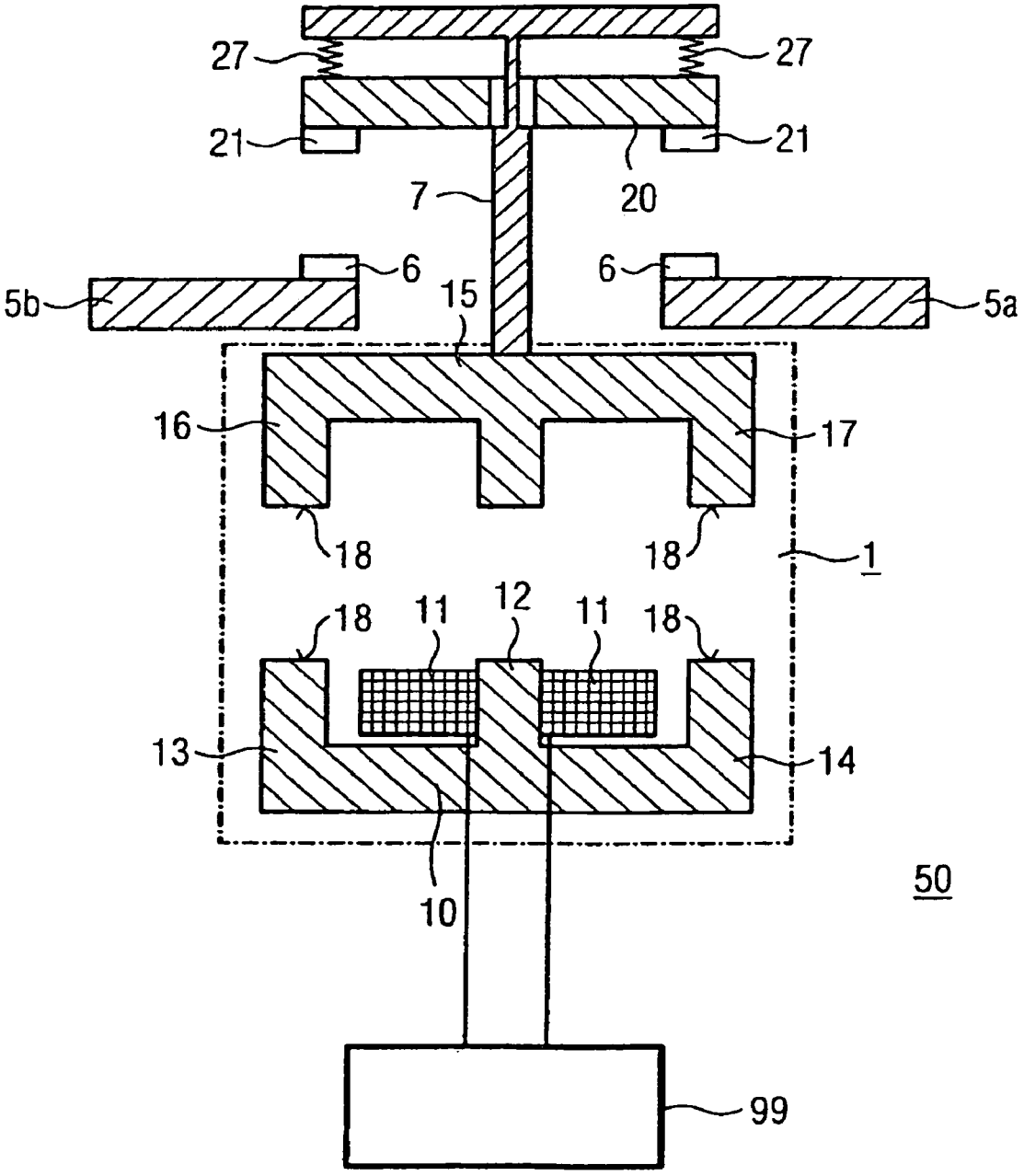
FIG. 1 illustrates a section of a conventional electromagnetic drive unit in an electromechanical switching device.
Figure 2:
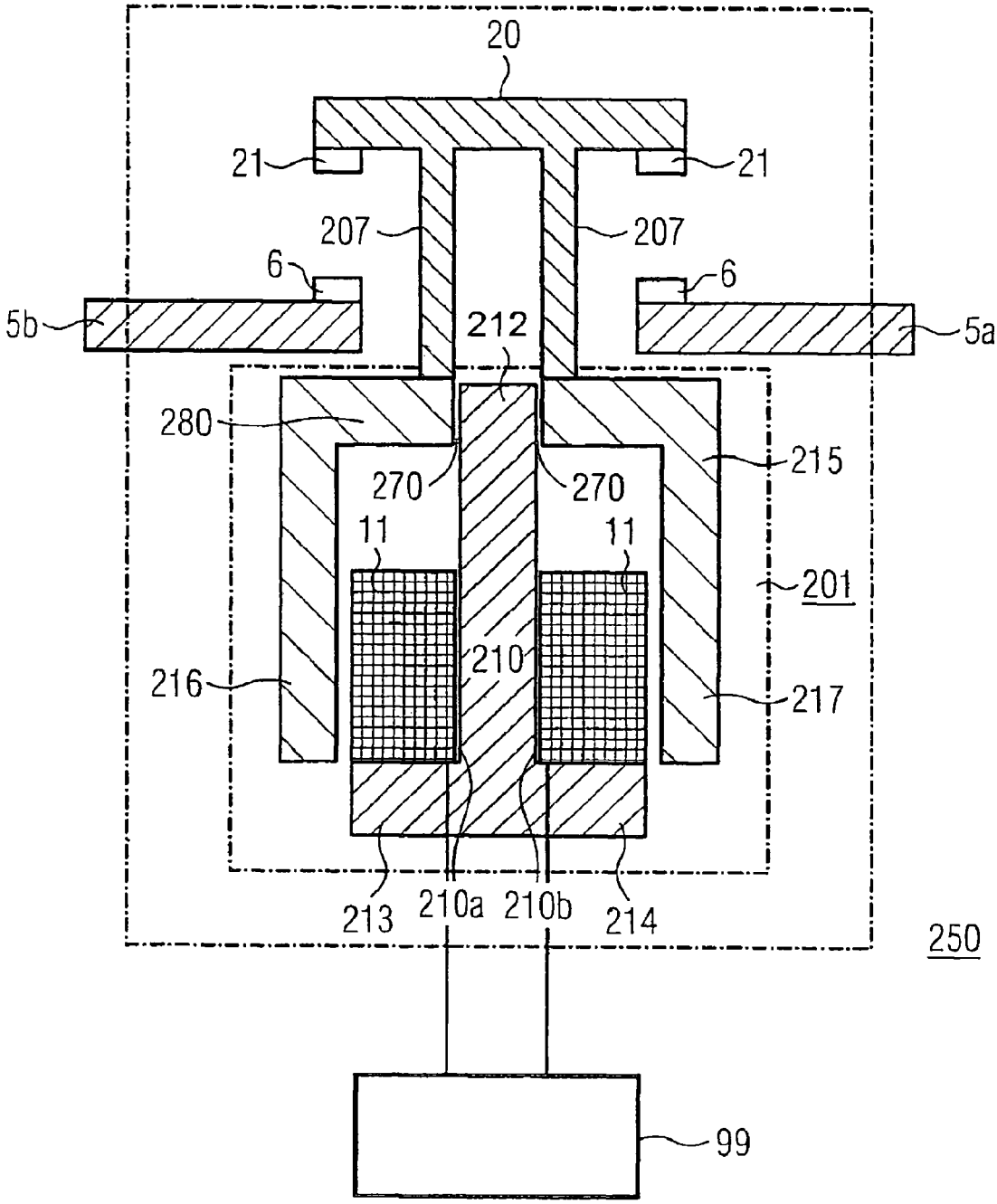
FIG. 2 illustrates a section of an electromagnetic drive unit according to the first aspect of an embodiment of the invention in an electromechanical switching device according to the second aspect of an embodiment of the invention, when the current path is open.

FIG. 2 illustrates a section of an electromagnetic drive unit 201 comprising a yoke 210, a coil 11 and a movable armature 215.

The at least one movable contact piece 21 and the at least one stationary contact piece 6 are adapted to limit movement of the armature 215 after activation of the coil 11. Additionally, the electromechanical switching device 250 may further comprise at least one stop adapted to limit movement of the armature 215 after activation of the electromagnetic drive unit 201.

The yoke 210 and the armature 215 may have a matched shape so that, when the electromagnetic drive unit 201 is activated by the control unit 99, the armature 215 is adapted to at least partially cross the yoke 210, preferably by sliding and so that a collision between the yoke 210 and the armature 215 can be avoided.

Figure 3:
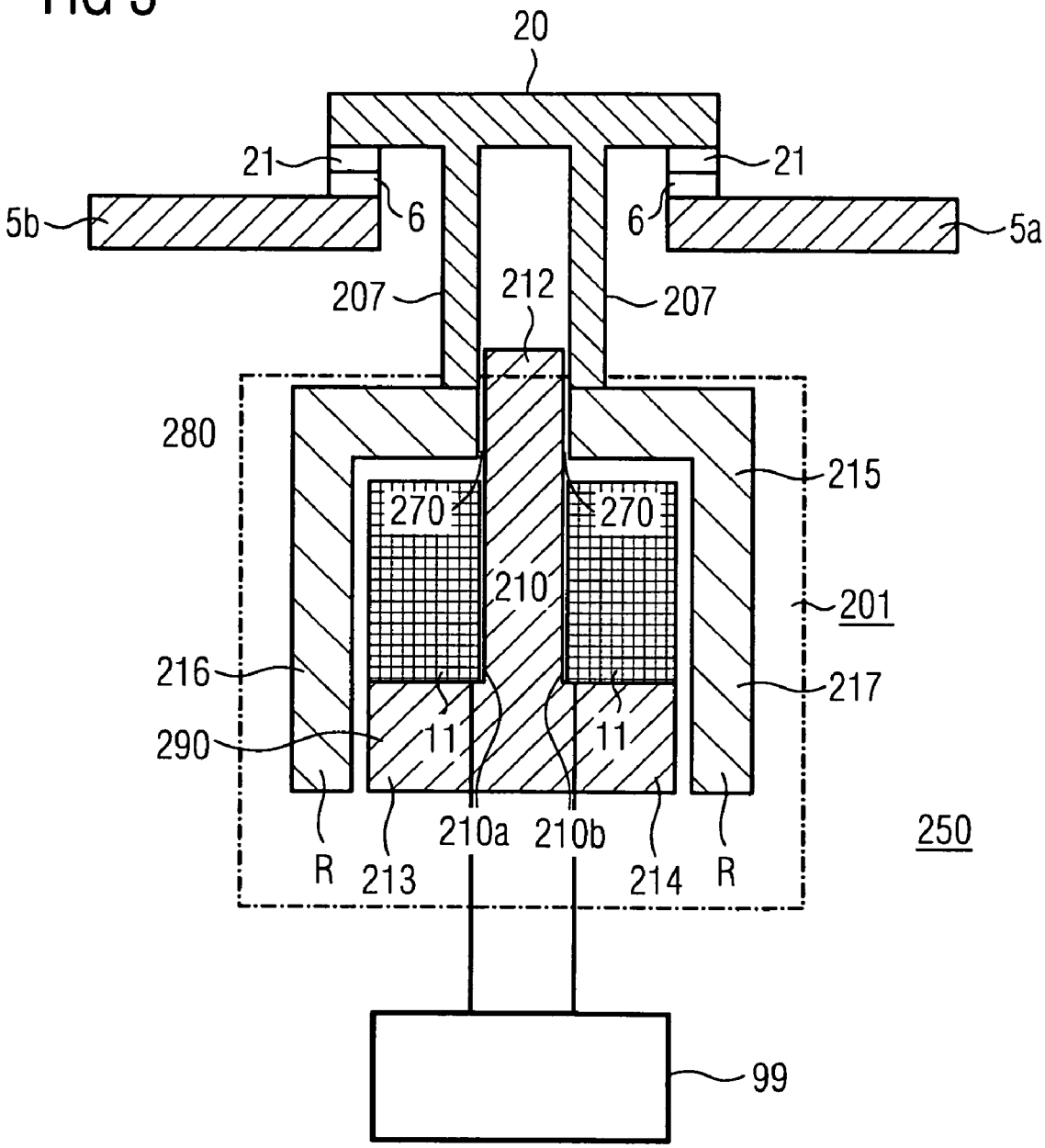
FIG. 3 is as FIG. 2 but when the current path is closed.

The movement of the armature 215 is limited, as shown in FIG. 3, by the movable contact piece 21 and the stationary contact piece 6 when they enter into contact with each other. The bar 207 attached to the contact bridge 20 carrying the movable contact pieces 21 exerts the limiting force to the armature 215.

Preferably, the yoke 210 comprises a leg 212 for accommodating the coil 11. Then the armature 215 may show at least one opening 270 adapted to let the leg 212 to at least partially to penetrate into the armature 215. In this manner, when the armature 215 is pulled towards the yoke 210, it can cross it in a contact less much or at least so that the clacking at the armature 215 against the yoke 210 can be avoided.

The yoke 210 may comprise one or two outer pole legs 213, 214, that enable the armature 215 to move past the responsive pole leg 213, 214.

The armature 215 may comprises legs 216, 217 that extend from a top part 280 of the armature 215 towards the yoke 210, comprising at least one region R adapted to reach the level of a base 290 of the yoke 210 upon activation of the coil 11.

In the example embodiment of the invention, however, the armature 215 has the shape of a pot core with a round cross-section, the edge thus replacing the legs 216, 217.

The armature 215 or the yoke 210 may comprise magnetic powder material, and optionally also a synthetic material, preferably a polymer, in particular epoxy resin. The magnetic powder material may be sintered. Particularly advantageous materials and methods for manufacturing the armature 215 or the yoke can be found in DE 10 331 339 A1 and in EP 1 101 233. Magnetic powder materials usually show a high magnetic permeability, in the range of $m_r$>5000. For synthetic materials, such as polymers, the magnetic permeability may be in the range $\mu_r \approx 1$. The resulting armature 215 or yoke 210 may thus have a magnetic permeability in the range of $\mu_r \in [50, 150]$. Preferably, both armature 215 and yoke 210 are made of the same material.

The dimensions of the magnetic circuit are preferably adapted to provide a contact force for pulling the armature 215 towards the yoke 210 that is large enough also when the armature 215 or the yoke 210 have been made using injection molding.

FIGS. 2 and 3 also show an electromechanical switching device 250 that in the example of FIGS. 2 and 3 is a contactor.

Alternatively, the electromechanical switching device may be multifunctional device comprising a contactor. In both cases, the contactor is preferably adapted to switch currents at the low-voltage level between 100 V and 1000 V.

The electromechanical switching device 250 comprises at least one stationary contact piece 6, at least one movable contact piece 21 movable to and from said at least one stationary contact piece 6 for opening or closing a current path 5*a*, 5*b*, and an electromagnetic drive unit 201. The electromagnetic drive unit 201 is adapted to displace said movable contact piece 21 in response to a voltage applied to the coil 11. A voltage can be applied to the coil, for example, by applying it via the ends of the winding.

FIGS. 2 and 3 show a simplified version of an electromechanical switching device 250 only. In many applications, almost simultaneous switching of two or three current phases is required. Therefore, an electromechanical switching device 250 may comprise at least one movable contact 21 and at least one stationary contact 6 for each phase. To increase stability of the mechanical switching and avoid contact burning, the movable contact pieces 21 and the stationary contact pieces 6 are usually provided in pairs; the movable contact pieces 21 are preferably carried on a robust contact bridge 20 that will not be deformed by the forces exerted by the bar 207.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electromechanical switching device, comprising:

at least one stationary contact piece;

at least one movable contact piece, movable to and from said at least one stationary contact piece, to open or close a current path; and an electromagnetic drive unit including a yoke and a coil and a movable armature that surrounds the coil, wherein the electromagnetic drive unit is adapted to displace said at least one movable contact piece in response to a voltage applied to the coil, said at least one movable contact piece and said at least one stationary contact piece limits movement of the movable armature after activation of the electromagnetic drive unit.

2. An electromechanical switching device according to claim 1, further comprising at least one stop adapted to limit movement of the armature after activation of the electromagnetic drive unit.

3. An electromechanical switching device according to claim 1, whereby said yoke and said armature have a matched shape so that, when the coil is activated, the armature at least partially crosses the yoke.

4. An electromechanical switching device according to claim 1, wherein the yoke comprises at least one of a leg and an edge that accommodates a coil, and wherein the armature includes at least one opening adapted to let said leg or edge to at least partially to penetrate into the armature.

5. An electromechanical switching device according to claim 1, wherein the yoke comprises at least one outer pole leg, or an edge that enables the armature to move past the responsive at least one outer pole leg.

6. An electromechanical switching device according to claim 1, wherein the armature comprises an edge that extends from a top part of the armature towards the yoke and comprises at least one region that reaches the level of a base of the yoke upon activation of the coil.

7. An electromechanical switching device according to claim 1, wherein at least one of said armature and said yoke comprises magnetic powder material.

8. An electromechanical switching device according to claim 7, wherein at least one of said armature and said yoke further comprises a synthetic material.

9. An electromechanical switching device according to claim 1, wherein said electromechanical switching device is a contactor or a multifunctional device comprising a contactor.

10. An electromechanical switching device according to claim 1, wherein the movable armature surrounds the yoke.

11. An electromechanical switching device according to claim 2, whereby said yoke and said armature have a matched shape so that, when the coil is activated, the armature is adapted to at least partially cross the yoke.

12. An electromechanical switching device according to claim 2, wherein the yoke comprises a leg or an edge for accommodating a coil, and wherein the armature shows at least one opening adapted to let said leg or edge to at least partially to penetrate into the armature.

13. An electromechanical switching device according to claim 2, wherein the yoke comprises at least one outer pole legs, or an edge that enables the armature to move past the responsive at least one outer pole leg.

14. An electromechanical switching device according to claim 2, wherein the armature comprises an edge that extends from a top part of the armature towards the yoke and comprises at least one region adapted to reach the level of a base of the yoke upon activation of the coil.

15. An electromechanical switching device according to claim 2, wherein at least one of said armature and said yoke comprises magnetic powder material.

16. An electromechanical switching device according to claim 15, wherein at least one of said armature and said yoke further comprises a synthetic material.

17. An electromechanical switching device according to claim 8, wherein said synthetic material is a polymer.

18. An electromechanical switching device according to claim 16, wherein said synthetic material is a polymer.

19. An electromechanical switching device according to claim 17, wherein said polymer is an epoxy resin.

20. An electromechanical switching device according to claim 18, wherein said polymer is an epoxy resin.

* * * * *